US012022884B2

(12) United States Patent
Lee et al.

(10) Patent No.: US 12,022,884 B2
(45) Date of Patent: Jul. 2, 2024

(54) AEROSOL GENERATING DEVICE AND OPERATION METHOD THEREOF

(71) Applicant: KT&G CORPORATION, Daejeon (KR)

(72) Inventors: Jae Min Lee, Siheung-si (KR); Sang Kyu Park, Seoul (KR)

(73) Assignee: KT&G CORPORATION, Daejeon (KR)

( * ) Notice: Subject to any disclaimer, the term of this patent is extended or adjusted under 35 U.S.C. 154(b) by 584 days.

(21) Appl. No.: 17/283,357

(22) PCT Filed: Jun. 11, 2020

(86) PCT No.: PCT/KR2020/007573

§ 371 (c)(1),
(2) Date: Apr. 7, 2021

(87) PCT Pub. No.: WO2020/256342

PCT Pub. Date: Dec. 24, 2020

(65) Prior Publication Data

US 2021/0345684 A1 Nov. 11, 2021

(30) Foreign Application Priority Data

Jun. 17, 2019 (KR) ..... 10-2019-0071771

(51) Int. Cl.
*A24F 40/60* (2020.01)
*A24F 40/51* (2020.01)
*A24F 40/53* (2020.01)

(52) U.S. Cl.
CPC ..... *A24F 40/60* (2020.01); *A24F 40/51* (2020.01); *A24F 40/53* (2020.01)

(58) Field of Classification Search
CPC ..... A24F 40/60; A24F 40/51; A24F 40/53; A24F 40/30; A24F 40/20; A24F 40/50; H05B 1/0277; H01B 1/00
(Continued)

(56) References Cited

U.S. PATENT DOCUMENTS 9,854,841 B2 1/2018 Ampolini et al.
9,904,359 B2 2/2018 Na et al.
(Continued)

FOREIGN PATENT DOCUMENTS

CN 105589594 A 5/2016
CN 106796452 A 5/2017
(Continued)

OTHER PUBLICATIONS

Office action for Korean application 10-2019-0071771 dated Nov. 18, 2020.
(Continued)

*Primary Examiner* — Alexander Gilman
(74) *Attorney, Agent, or Firm* — Sughrue Mion, PLLC

(57) ABSTRACT

An aerosol generating device includes a heater configured to heat an aerosol generating substrate, at least one sensor configured to sense a tap input of a user, and a controller configured to receive a sensing value indicating the tap input from the at least one sensor, count a number of tap inputs based on the received sensing value being greater than a variable threshold, and operate the heater based on whether the counted number of tap inputs reaches a predetermined input number, wherein the controller adjusts the variable threshold based on the counted number of tap inputs.

15 Claims, 6 Drawing Sheets

(58) Field of Classification Search
USPC ..... 131/329
See application file for complete search history.

(56) References Cited

U.S. PATENT DOCUMENTS

| | | | | |
|---|---|---|---|---|
| 10,440,992 | B2 * | 10/2019 | Sur | A24F 40/65 |
| 10,925,316 | B2 | 2/2021 | Batista et al. | |
| 11,275,440 | B2 | 3/2022 | Haga et al. | |
| 11,357,936 | B2 | 6/2022 | Lipowicz | |
| 11,617,395 | B2 * | 4/2023 | Farine | A24F 40/30 131/328 |
| 2012/0048266 | A1 * | 3/2012 | Alelov | A61M 15/0065 128/203.14 |
| 2014/0123990 | A1 | 5/2014 | Timmermans | |
| 2014/0334804 | A1 | 11/2014 | Choi | |
| 2015/0245658 | A1 * | 9/2015 | Worm | A24F 40/50 131/328 |
| 2016/0150825 | A1 * | 6/2016 | Mironov | A24F 40/46 219/634 |
| 2017/0027233 | A1 * | 2/2017 | Mironov | A24F 40/465 |
| 2017/0055587 | A1 * | 3/2017 | Zinovik | H05B 6/36 |
| 2017/0086508 | A1 * | 3/2017 | Mironov | A24F 40/46 |
| 2017/0105452 | A1 * | 4/2017 | Mironov | H05B 1/0244 |
| 2017/0245547 | A1 * | 8/2017 | Lipowicz | A61M 15/008 |
| 2017/0245548 | A1 * | 8/2017 | Nedelman | A24F 1/30 |
| 2018/0184711 | A1 * | 7/2018 | Dickens | A24F 40/51 |
| 2019/0053541 | A1 * | 2/2019 | Rojo-Calderon | A24D 1/002 |
| 2019/0297950 | A1 | 10/2019 | Wendt Thevenaz et al. | |
| 2020/0154773 | A1 | 5/2020 | Lim et al. | |
| 2021/0084986 | A1 * | 3/2021 | Hepworth | A24F 40/50 |
| 2021/0227889 | A1 * | 7/2021 | Lim | A24D 1/20 |
| 2021/0401044 | A1 | 12/2021 | Qiu et al. | |

FOREIGN PATENT DOCUMENTS

| | | | |
|---|---|---|---|
| CN | 109717519 | A | 5/2019 |
| JP | 2015-114283 | A | 6/2015 |
| JP | 3213257 | U | 10/2017 |
| JP | 2019-511909 | A | 5/2019 |
| KR | 10-1345358 | B1 | 12/2013 |
| KR | 10-2015-0064754 | A | 6/2015 |
| KR | 10-2018-0015622 | A | 2/2018 |
| KR | 10-2018-0070440 | A | 6/2018 |
| KR | 10-2018-0116249 | A | 10/2018 |
| KR | 10-2018-0125020 | A | 11/2018 |
| WO | 2017/001817 | A1 | 1/2017 |
| WO | 2018/185460 | A1 | 10/2018 |

OTHER PUBLICATIONS

Written opinion for PCT/KR2020/007573 dated Nov. 24, 2020.
International search report for PCT/KR2020/007573 dated Nov. 24, 2020.
Chinese Office Action dated Apr. 17, 2023 in Chinese Application No. 202080006443.5.
Office Action dated May 24, 2022 from the Japanese Patent Office in JP Application No. 2021-523008.
Office Action dated Oct. 20, 2021 in Korean Application No. 10-2021-0090983.
Extended European Search Report dated Oct. 8, 2021 in European Application No. 20827502.4.

* cited by examiner

AEROSOL GENERATING DEVICE AND OPERATION METHOD THEREOF

TECHNICAL FIELD

The disclosure relates to a device and a method for generating aerosol, and more particularly, to a device and a method for generating aerosol by operating a heater to heat an aerosol generating substrate according to user's input.

BACKGROUND ART

Demand for alternatives to overcome the shortcomings of traditional combustive cigarettes has increased. For example, there is growing demand for an aerosol generating device that generates aerosol by heating an aerosol generating material in a cigarette or a liquid container, not by combusting a cigarette.

An aerosol generating device may be designed to heat a heater only when receiving consecutive tap inputs for prevention of malfunction. In this case, the strength of a user's finger may rapidly decrease due to stress on the finger, and thus the aerosol generating device may not accurately receive the user input.

As a result, the aerosol generating device may fail to recognize some or all of the user's consecutive taps, and a heater may not be heated despite the user's input.

DISCLOSURE

Technical Solution

Provided is an aerosol generating device and an operation method thereof, which may enable accurate recognition of user inputs by adjusting sensitivity of a sensor that detects user inputs.

According to an embodiment of the disclosure, an aerosol generating device includes a heater configured to heat an aerosol generating substrate, at least one sensor configured to sense a tap input of a user, and a controller configured to receive a sensing value indicating the tap input from the at least one sensor, count a number of tap inputs based on the received sensing value being greater than a variable threshold, and operate the heater based on whether the counted number of tap inputs reaches a predetermined input number. The controller adjusts the variable threshold on the basis of the counted number of tap inputs.

Advantageous Effects

In an aerosol generating device and an operation method thereof according to an embodiment of the disclosure, as the sensitivity of a sensor is adjusted in response to a user's tap input frequency, the user input may be accurately recognized.

Furthermore, in the aerosol generating device and the operation method thereof, as the user input is accurately recognized, user convenience may be improved.

The effects of the disclosure are not limited to the contents disclosed herein, and other various effects may be further included in the specification.

BEST MODE

Figure 1:
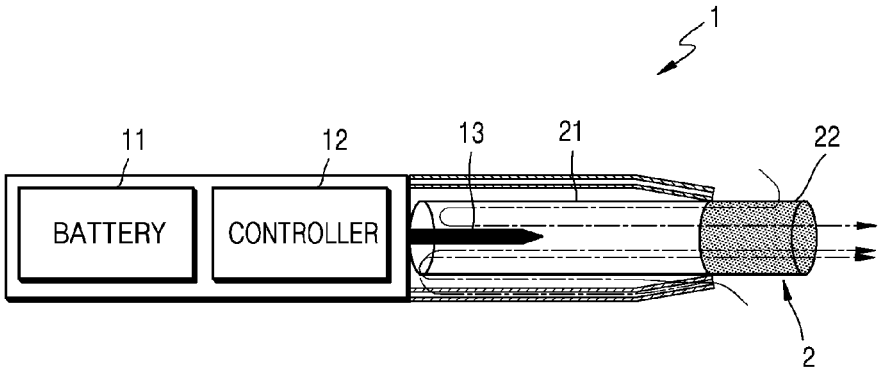
FIGS. 1 to 3 are views illustrating examples in which a cigarette is inserted into an aerosol generating device.

According to an embodiment of the disclosure, an aerosol generating device may include a heater configured to heat an aerosol generating substrate, at least one sensor configured to sense a tap input of a user, and a controller configured to receive a sensing value indicating the tap input from the at least one sensor, count a number of tap inputs based on the received sensing value being greater than a variable threshold, and operate the heater based on whether the counted number of tap inputs reaches a predetermined input number. The controller may adjust the variable threshold on the basis of the counted number of tap inputs.

Furthermore, the controller may decrease the variable threshold in inverse proportion to the counted number of tap inputs.

Furthermore, the controller may decrease the variable threshold based on the counted number of tap inputs reaching a reference input number.

Furthermore, the reference input number may be set to two times.

Furthermore, the controller may count the number of tap inputs based on the sensing value being received within a predetermined input time after a previous sensing value is received.

Furthermore, the controller may further include a counter configured to count the number of tap inputs.

Furthermore, the controller may initialize the variable threshold based on no sensing value being received within a predetermined input time after the variable threshold is adjusted.

Furthermore, the sensor may include an acceleration sensor that senses a change of acceleration of the aerosol generating device.

Furthermore, the aerosol generating device may further include a battery configured to supply power to the heater, wherein the controller controls the battery to supply power to the heater when the number of tap inputs reaches a predetermined input number.

According to another embodiment of the disclosure, a method of operating an aerosol generating device includes sensing a tap input of a user, receiving a sensing value indicating the tap input, counting a number of tap inputs when the received sensing value is greater than a variable threshold, and adjusting the variable threshold on the basis of the counted number of tap inputs.

Furthermore, the adjusting of the threshold may include decreasing the variable threshold in inverse proportion to the counted number of tap inputs.

Furthermore, the adjusting of the threshold may include, decreasing the variable threshold based on the counted number of tap inputs reaching a reference input number.

Furthermore, the counting of the number of tap inputs may include counting the number of tap inputs based on the sensing value being received within a predetermined input time after a previous sensing value is received.

Furthermore, the method may further include initializing the variable threshold based on no sensing value being received within a predetermined input time after the variable threshold is adjusted.

Furthermore, the method may further include supplying power to a heater when the number of tap inputs reaches a predetermined input number.

MODE FOR INVENTION

With respect to the terms in the various embodiments, the general terms which are currently and widely used are selected in consideration of functions of structural elements in the various embodiments of the present disclosure. However, meanings of the terms can be changed according to intention, a judicial precedence, the appearance of a new technology, and the like. In addition, in certain cases, a term which is not commonly used can be selected. In such a case, the meaning of the term will be described in detail at the corresponding portion in the description of the present disclosure. Therefore, the terms used in the various embodiments of the present disclosure should be defined based on the meanings of the terms and the descriptions provided herein.

In addition, unless explicitly described to the contrary, the word "comprise" and variations such as "comprises" or "comprising" will be understood to imply the inclusion of stated elements but not the exclusion of any other elements. In addition, the terms "-er", "-or", and "module" described in the specification mean units for processing at least one function and operation and can be implemented by hardware components or software components and combinations thereof.

As used herein, expressions such as "at least one of," when preceding a list of elements, modify the entire list of elements and do not modify the individual elements of the list. For example, the expression, "at least one of a, b, and c," should be understood as including only a, only b, only c, both a and b, both a and c, both b and c, or all of a, b, and c.

It will be understood that when an element or layer is referred to as being "over," "above," "on," "connected to" or "coupled to" another element or layer, it can be directly over, above, on, connected or coupled to the other element or layer or intervening elements or layers may be present. In contrast, when an element is referred to as being "directly over," "directly above," "directly on," "directly connected to" or "directly coupled to" another element or layer, there are no intervening elements or layers present. Like numerals refer to like elements throughout.

Hereinafter, the present disclosure will now be described more fully with reference to the accompanying drawings, in which exemplary embodiments of the present disclosure are shown such that one of ordinary skill in the art may easily work the present disclosure. The disclosure may, however, be embodied in many different forms and should not be construed as being limited to the embodiments set forth herein.

Figure 2:
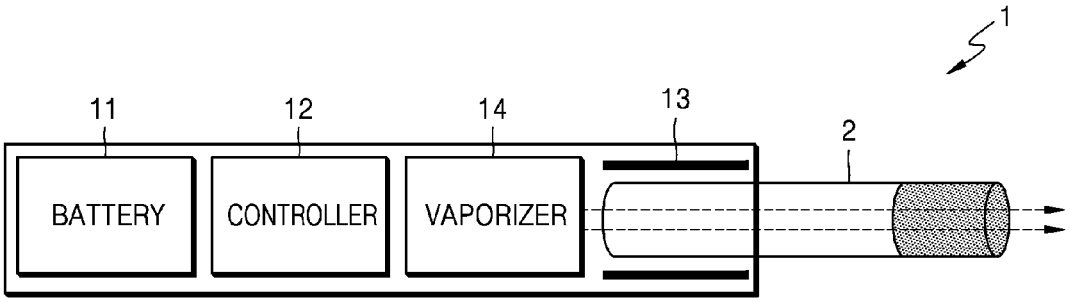
Figure 3:
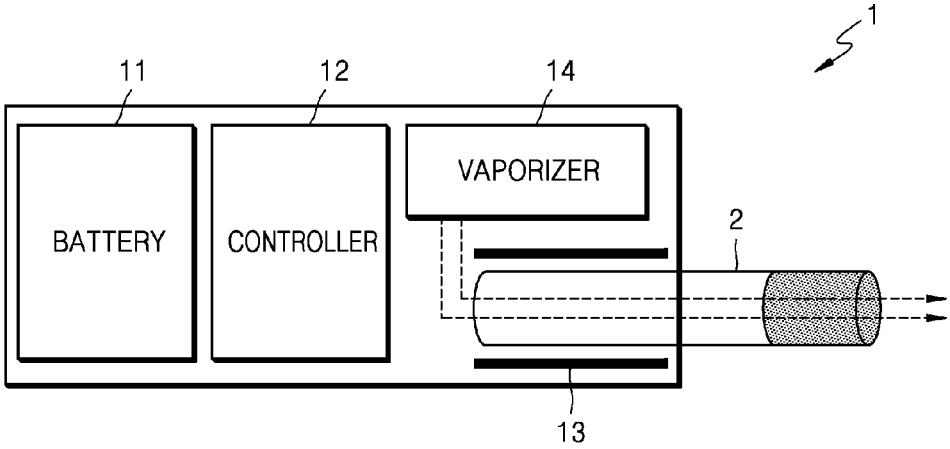

FIGS. 1 through 3 are diagrams showing examples in which a cigarette is inserted into an aerosol generating device.

Referring to FIG. 1, the aerosol generating device 1 may include a battery 11, a controller 12, and a heater 13. Referring to FIGS. 2 and 3, the aerosol generating device 1 may further include a vaporizer 14. Also, the cigarette 2 may be inserted into an inner space of the aerosol generating device 1.

FIGS. 1 through 3 illustrate components of the aerosol generating device 1, which are related to the present embodiment. Therefore, it will be understood by one of ordinary skill in the art related to the present embodiment that other general-purpose components may be further included in the aerosol generating device 1, in addition to the components illustrated in FIGS. 1 through 3.

Also, FIGS. 2 and 3 illustrate that the aerosol generating device 1 includes the heater 13. However, as necessary, the heater 13 may be omitted.

FIG. 1 illustrates that the battery 11, the controller 12, and the heater 13 are arranged in series. Also, FIG. 2 illustrates that the battery 11, the controller 12, the vaporizer 14, and the heater 13 are arranged in series. Also, FIG. 3 illustrates that the vaporizer 14 and the heater 13 are arranged in parallel. However, the internal structure of the aerosol generating device 1 is not limited to the structures illustrated in FIGS. 1 through 3. In other words, according to the design of the aerosol generating device 1, the battery 11, the controller 12, the heater 13, and the vaporizer 14 may be differently arranged.

When the cigarette 2 is inserted into the aerosol generating device 1, the aerosol generating device 1 may operate the heater 13 and/or the vaporizer 14 to generate an aerosol from the cigarette 2 and/or the vaporizer 14. The aerosol generated by the heater 13 and/or the vaporizer 14 is delivered to a user by passing through the cigarette 2.

As necessary, even when the cigarette 2 is not inserted into the aerosol generating device 1, the aerosol generating device 1 may heat the heater 13.

The battery 11 may supply power to be used for the aerosol generating device 1 to operate. For example, the battery 11 may supply power to heat the heater 13 or the vaporizer 14, and may supply power for operating the controller 12. Also, the battery 11 may supply power for operations of a display, a sensor, a motor, etc. mounted in the aerosol generating device 1.

The controller 12 may generally control operations of the aerosol generating device 1. In detail, the controller 12 may control not only operations of the battery 11, the heater 13, and the vaporizer 14, but also operations of other components included in the aerosol generating device 1. Also, the controller 12 may check a state of each of the components of the aerosol generating device 1 to determine whether or not the aerosol generating device 1 is able to operate.

The controller 12 may include at least one processor. A processor can be implemented as an array of a plurality of logic gates or can be implemented as a combination of a microprocessor and a memory in which a program executable in the microprocessor is stored. It will be understood by one of ordinary skill in the art that the processor can be implemented in other forms of hardware.

The heater 13 may be heated by the power supplied from the battery 11. For example, when the cigarette 2 is inserted into the aerosol generating device 1, the heater 13 may be located outside the cigarette 2. Thus, the heated heater 13 may increase a temperature of an aerosol generating material in the cigarette 2.

The heater 13 may include an electro-resistive heater. For example, the heater 13 may include an electrically conductive track, and the heater 13 may be heated when currents flow through the electrically conductive track. However, the heater 13 is not limited to the example described above and may include all heaters which may be heated to a desired temperature. Here, the desired temperature may be pre-set in the aerosol generating device 1 or may be set as a temperature desired by a user.

As another example, the heater 13 may include an induction heater. In detail, the heater 13 may include an electrically conductive coil for heating a cigarette in an induction heating method, and the cigarette may include a susceptor which may be heated by the induction heater.

For example, the heater 13 may include a tube-type heating element, a plate-type heating element, a needle-type heating element, or a rod-type heating element, and may heat the inside or the outside of the cigarette 2, according to the shape of the heating element.

Also, the aerosol generating device 1 may include a plurality of heaters 13. Here, the plurality of heaters 13 may be inserted into the cigarette 2 or may be arranged outside the cigarette 2. Also, some of the plurality of heaters 13 may be inserted into the cigarette 2 and the others may be arranged outside the cigarette 2. In addition, the shape of the heater 13 is not limited to the shapes illustrated in FIGS. 1 through 3 and may include various shapes.

The vaporizer 14 may generate aerosol by heating a liquid composition and the generated aerosol may pass through the cigarette 2 to be delivered to a user. In other words, the aerosol generated via the vaporizer 14 may move along an air flow passage of the aerosol generating device 1 and the air flow passage may be configured such that the aerosol generated via the vaporizer 14 passes through the cigarette 2 to be delivered to the user.

For example, the vaporizer 14 may include a liquid storage, a liquid delivery element, and a heating element, but it is not limited thereto. For example, the liquid storage, the liquid delivery element, and the heating element may be included in the aerosol generating device 1 as independent modules.

The liquid storage may store a liquid composition. For example, the liquid composition may be a liquid including a tobacco-containing material having a volatile tobacco flavor component, or a liquid including a non-tobacco material. The liquid storage may be formed to be detachable from the vaporizer 14 or may be formed integrally with the vaporizer 14.

For example, the liquid composition may include water, a solvent, ethanol, plant extract, spices, flavorings, or a vitamin mixture. The spices may include menthol, peppermint, spearmint oil, and various fruit-flavored ingredients, but are not limited thereto. The flavorings may include ingredients capable of providing various flavors or tastes to a user. Vitamin mixtures may be a mixture of at least one of vitamin A, vitamin B, vitamin C, and vitamin E, but are not limited thereto. Also, the liquid composition may include an aerosol forming substance, such as glycerin and propylene glycol.

The liquid delivery element may deliver the liquid composition of the liquid storage to the heating element. For example, the liquid delivery element may be a wick such as cotton fiber, ceramic fiber, glass fiber, or porous ceramic, but is not limited thereto.

The heating element is an element for heating the liquid composition delivered by the liquid delivery element. For example, the heating element may be a metal heating wire, a metal hot plate, a ceramic heater, or the like, but is not limited thereto. In addition, the heating element may include a conductive filament such as nichrome wire and may be positioned as being wound around the liquid delivery element. The heating element may be heated by a current supply and may transfer heat to the liquid composition in contact with the heating element, thereby heating the liquid composition. As a result, aerosol may be generated.

For example, the vaporizer 14 may be referred to as a cartomizer or an atomizer, but it is not limited thereto.

The aerosol generating device 1 may further include other components in addition to the battery 11, the controller 12, the heater 13, and the vaporizer 14. For example, the aerosol generating device 1 may include a display capable of outputting visual information and/or a motor for outputting haptic information. Also, the aerosol generating device 1 may include at least one sensor (e.g., a puff detecting sensor, a temperature detecting sensor, a cigarette insertion detecting sensor, etc.). Also, the aerosol generating device 1 may be formed as a structure where, even when the cigarette 2 is inserted into the aerosol generating device 1, external air may be introduced or internal air may be discharged.

Although not illustrated in FIGS. 1 through 3, the aerosol generating device 1 and an additional cradle may form together a system. For example, the cradle may be used to charge the battery 11 of the aerosol generating device 1. Alternatively, the heater 13 may be heated when the cradle and the aerosol generating device 1 are coupled to each other.

The cigarette 2 may be similar to a general combustive cigarette. For example, the cigarette 2 may be divided into a first portion including an aerosol generating material and a second portion including a filter, etc. Alternatively, the second portion of the cigarette 2 may also include an aerosol generating material. For example, an aerosol generating material made in the form of granules or capsules may be inserted into the second portion.

The entire first portion may be inserted into the aerosol generating device 1, and the second portion may be exposed to the outside. Alternatively, only a portion of the first portion may be inserted into the aerosol generating device 1, or the entire first portion and a portion of the second portion may be inserted into the aerosol generating device 1. The user may puff aerosol while holding the second portion by the mouth of the user. In this case, the aerosol is generated by the external air passing through the first portion, and the generated aerosol passes through the second portion and is delivered to the user's mouth.

For example, the external air may flow into at least one air passage formed in the aerosol generating device 1. For example, opening and closing of the air passage and/or a size of the air passage may be adjusted by the user. Accordingly, the amount and quality of vapor may be adjusted by the user. As another example, the external air may flow into the cigarette 2 through at least one hole formed in a surface of the cigarette 2.

Hereinafter, an example of the cigarette 2 will be described with reference to FIG. 4.

Figure 4:
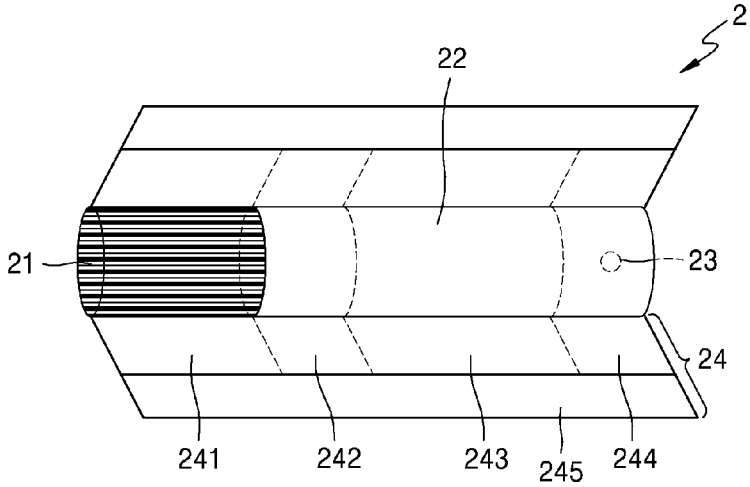
FIGS. 4 and 5 are views illustrating examples of a cigarette.

FIG. 4 illustrates an example of a cigarette.

Referring to FIG. 4, the cigarette 2 may include a tobacco rod 21 and a filter rod 22. The first portion 21 described above with reference to FIGS. 1 through 3 may include the tobacco rod, and the second portion may include the filter rod 22.

FIG. 4 illustrates that the filter rod 22 includes a single segment. However, the filter rod 22 is not limited thereto. In other words, the filter rod 22 may include a plurality of segments. For example, the filter rod 22 may include a first segment configured to cool an aerosol and a second segment configured to filter a certain component included in the aerosol. Also, as necessary, the filter rod 22 may further include at least one segment configured to perform other functions.

The cigarette 2000 may be packaged by at least one wrapper 24. The wrapper 24 may have at least one hole through which external air may be introduced or internal air may be discharged. For example, the cigarette 2 may be packaged by one wrapper 24. As another example, the cigarette 2 may be doubly packaged by at least two wrappers 24. For example, the tobacco rod 21 may be packaged by a first wrapper, and the filter rod 22 may be packaged by a second wrapper. Also, the tobacco rod 21 and the filter rod 22, which are respectively packaged by separate wrappers, may be coupled to each other, and the entire cigarette 2 may be packaged by a third wrapper. When each of the tobacco rod 21 and the filter rod 22 includes a plurality of segments, each segment may be packaged by a separate wrapper.

The tobacco rod 21 may include an aerosol generating material. For example, the aerosol generating material may include at least one of glycerin, propylene glycol, ethylene glycol, dipropylene glycol, diethylene glycol, triethylene glycol, tetraethylene glycol, and oleyl alcohol, but it is not limited thereto. Also, the tobacco rod 21 may include other additives, such as flavors, a wetting agent, and/or organic acid. Also, the tobacco rod 21 may include a flavored liquid, such as menthol or a moisturizer, which is injected to the tobacco rod 21.

The tobacco rod 21 may be manufactured in various forms. For example, the tobacco rod 21 may be formed as a sheet or a strand. Also, the tobacco rod 21 may be formed as a pipe tobacco, which is formed of tiny bits cut from a tobacco sheet. Also, the tobacco rod 21 may be surrounded by a heat conductive material. For example, the heat-conducting material may be, but is not limited to, a metal foil such as aluminum foil. For example, the heat conductive material surrounding the tobacco rod 21 may uniformly distribute heat transmitted to the tobacco rod 21, and thus, the heat conductivity of the tobacco rod may be increased and taste of the tobacco may be improved. Also, the heat conductive material surrounding the tobacco rod 21 may function as a susceptor heated by the induction heater. Here, although not illustrated in the drawings, the tobacco rod 21 may further include an additional susceptor, in addition to the heat conductive material surrounding the tobacco rod 21.

The filter rod 22 may include a cellulose acetate filter. Shapes of the filter rod 22 are not limited. For example, the filter rod 22 may include a cylinder-type rod or a tube-type rod having a hollow inside. Also, the filter rod 22 may include a recess-type rod. When the filter rod 22 includes a plurality of segments, at least one of the plurality of segments may have a different shape.

Also, the filter rod 22 may include at least one capsule 23. Here, the capsule 23 may generate a flavor or an aerosol. For example, the capsule 23 may have a configuration in which a liquid containing a flavoring material is wrapped with a film. For example, the capsule 23 may have a spherical or cylindrical shape, but is not limited thereto.

Figure 5:
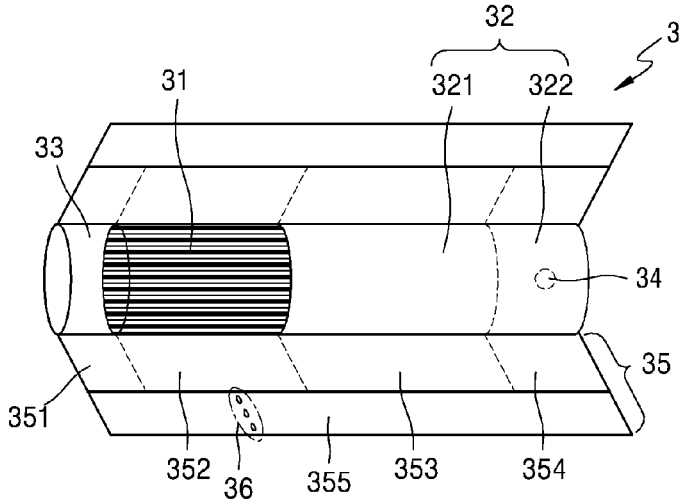

Referring to FIG. 5, the cigarette 3 may further include a front-end plug 33. The front-end plug 33 may be located on a side of the tobacco rod 42, the side not facing the filter rod 32. The front-end plug 33 may prevent the tobacco rod 31 from being detached outwards and prevent liquefied aerosol from flowing into the aerosol generating device 1 from the tobacco rod 31, during smoking.

The filter rod 32 may include a first segment 321 and second segment 322. Here, the first segment 321 may correspond to a first segment of a filter rod 22 of FIG. 4, and the second segment 322 may correspond to a third segment of a filter rod 22 of FIG. 4.

The diameter and total length of the cigarette 3 may correspond to the diameter and total length of the cigarette 2 of FIG. 4. For example, the length of the front-end plug 33 may be about 7 mm, the length of the tobacco rod 31 may be about 15 mm, the length of the first segment 321 may be about 12 mm, and the length of the second segment 322 may be about 14 mm, but it is not limited to this.

The cigarette 3 may be packaged by at least one wrapper 35. The wrapper 35 may have at least one hole through which external air may be introduced or internal air may be discharged. For example, the front-end plug 33 may be packaged by a first wrapper 351, and the tobacco rod 31 may be packaged by a second wrapper 352, and the first segment 321 may be packaged by a third wrapper 321, and the second segment 322 may be packaged by a fourth wrapper 354. Also, the entire cigarette 3 may be packaged by a fifth wrapper 355.

Also, the fifth wrapper 355 may have at least one hole 36. For example, the hole 36 may be formed in an area surrounding the tobacco rod 31, but is not limited thereto. The hole 36 may serve to transfer heat generated by the heater 13 to the inside of the tobacco rod 31.

Also, the second segment 322 may include at least one capsule 34. Here, the capsule 34 may generate a flavor and/or aerosol. For example, the capsule 34 may have a configuration in which a liquid containing a flavoring material is wrapped with a film. For example, the capsule 34 may have a spherical or cylindrical shape, but is not limited thereto.

Figure 6:
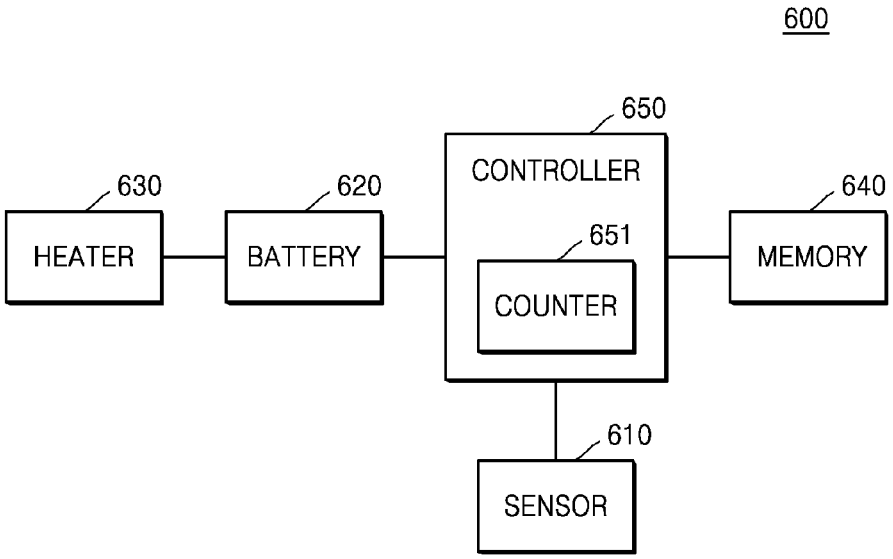
FIG. 6 is a block diagram of the inside of an aerosol generating device according to an embodiment of the disclosure.

FIG. 6 is a block diagram of the inside of an aerosol generating device 600 according to an embodiment of the disclosure.

Referring to FIG. 6, the aerosol generating device 600 according to an embodiment may include a sensor 610, a battery 620, a heater 630, a memory 640, and a controller 650. The battery 620, the heater 630, and the controller 650 of FIG. 6 may correspond to the battery 11, the heater 13, and the controller 12 of FIGS. 1 to 3, respectively.

The inner structure of the aerosol generating device 600 is not limited to that illustrated in FIG. 6. One or more components illustrated in FIG. 6 may be omitted and/or a new component may be added, as necessary.

The controller 650 may control the sensor 610, the battery 620, the heater 630, and the memory 640 included in the aerosol generating device 600.

The sensor 610 may sense a movement of the aerosol generating device 600, and transmit to the controller 650 a sensing value corresponding to the movement of the aerosol generating device 600.

The sensor 610 may include at least one of an acceleration sensor, a gyro sensor, a pressure sensor, or a vibration sensor.

When the sensor 610 is an acceleration sensor, the acceleration sensor may sense a change of acceleration according to the movement of the aerosol generating device 600. The movement of the aerosol generating device 600 may be generated by a user's tap input. The acceleration sensor may sense a change of acceleration of the aerosol generating device 600 with respect to a user's tap input, and output to the controller 650 a sensing value corresponding to the change of acceleration of the aerosol generating device 600. For example, the acceleration sensor may output a voltage of 7 mV in response to the change of acceleration of the aerosol generating device 600. The output voltage of 7 mV may be input, as a sensing value, to the controller 650.

The acceleration sensor may output a voltage in proportion to the change of acceleration of the aerosol generating device 600.

The controller 650 may receive from the sensor 610 a sensing value indicating a tap input. The controller 650 may count a sensing value greater than a variable threshold as a user's tap input.

The variable threshold may indicate a minimum sensing value for recognizing a user's tap input.

When the sensor 610 is an acceleration sensor, the variable threshold may be related to the sensitivity of the acceleration sensor. Also, the variable threshold may decide measurement ability (i.e., dynamic range) of the acceleration sensor. For example, the sensitivity of an acceleration sensor may increase if a minimum sensing value for a user's tap input decreases.

The controller 650 may count the number of tap inputs. To this end, the controller 650 may include a counter 651. According to an embodiment, the counter 651 may be an independent component which is disposed outside the controller 650.

The controller 650 may count the number of tap inputs when a new value is received within a predetermined input time after the previous sensing value is received. The controller 650 may initialize the number of tap inputs if no sensing value is received within a predetermined input time after a sensing value is received. The predetermined input time may be appropriately set considering user's consecutive tap input time. For example, the predetermined input time may be 0.2 seconds, but the disclosure is not limited thereto.

The controller 650 may adjust a variable threshold on the basis of the counted number of tap inputs.

In detail, the controller 650 may decrease the variable threshold in proportion to the counted number of tap inputs.

Alternatively, the controller 650 may decrease the variable threshold to a second threshold less than the first threshold when the counted number of tap inputs reaches a reference input number while maintaining the first threshold. The reference input number may be set smaller than an operation input number, which will be described later. For example, the operation input number may be set to three times to prevent heating of the heater 630 due to malfunction of the aerosol generating device 600, and the reference input number may be set to two times. In this case, the variable threshold may be decreased from the third tap input.

The controller 650 may initialize the variable threshold when no sensing value is received within the predetermined input time after the variable threshold is adjusted. The predetermined input time may be appropriately set considering the user's consecutive tap input time. For example, the predetermined time may be 0.2 seconds, but the disclosure is not limited thereto. The reason for initializing the variable threshold is that, when the decreased variable threshold is maintained even without additional user's tap input, a malfunction of the aerosol generating device 600 may occur.

The battery 620 may supply power to the heater 630, and the amount of power supplied to the heater 630 may be controlled by the controller 650.

When a current is applied to the heater 630, the heater 630 generates heat due to specific resistance. If an aerosol generating substrate is heated by the heater 630, aerosol may be generated.

The controller 650 may control the power supplied to the heater 630 through a method of transmitting a pulse width modulation (PWM) signal to the heater 630.

The controller 650 may determine whether to operate the heater 630 on the basis of the user's tap input number.

The controller 650 may supply the power to the heater 630 by controlling the battery 620 when the user's tap input number is more than a predetermined input number. In this case, the input may be to operate the heater 630. Accordingly, the predetermined input number may be referred to as an operation input number. The operation input number may be set to three times. The reason for setting the operation input number to three times is to prevent heating of the heater 630 due to the malfunction of the aerosol generating device 600. For example, when the aerosol generating device 600 falls and collides with the ground surface, the sensor 610 may generally output two times a sensing value that is greater than or equal to the variable threshold. In this case, the controller 650 may determine that user's consecutive tap inputs are received and thus control the battery 620 to heat the heater 630. Accordingly, the heater 630 may be heated regardless of user's intention. Accordingly, in order to prevent the heating of the heater 630 regardless of user's intention, for example, the operation input number may be set to three times.

As the sensor 610 may receive a user input to heat the heater 630, a physical button of the aerosol generating device 600 may be omitted.

The memory 640 may store information for an operation of the aerosol generating device 600.

The memory 640 may store information regarding a reference input number, an operation input number, an input time, a variable threshold, a first threshold, a second threshold, a number of tap inputs, etc.

The sensor 610, the battery 620, the heater 630, the memory 640, and the controller 650 according to an embodiment of the disclosure may correspond to at least one processor or may include at least one processor. Accordingly, the sensor 610, the battery 620, the heater 630, the memory 640, and the controller 650 may be driven by being included in other hardware device such as a microprocessor or a general-purpose computer system.

Figure 7:
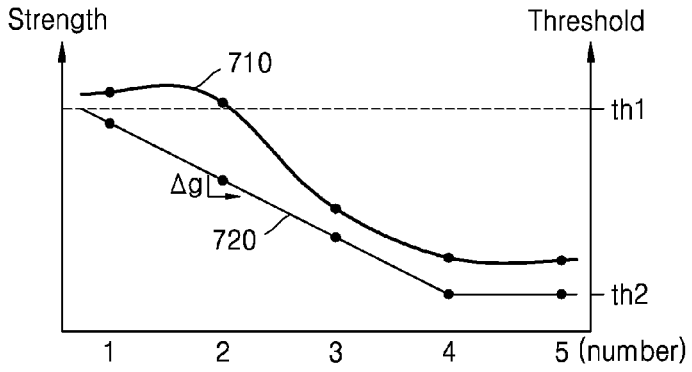
FIG. 7 is a graph of a method of adjusting a threshold of a sensor, according to an embodiment of the disclosure.

FIG. 7 is a graph of a method of adjusting a threshold of a sensor, according to an embodiment of the disclosure.

Referring to FIG. 7, the aerosol generating device 600 may receive a user input for heating the heater 630. Specifically, the aerosol generating device 600 may receive user's consecutive tap inputs to heat the heater 630.

The sensor 610 may receive user's consecutive tap inputs to heat the heater 630.

The controller 650 may count the number of tap inputs. The controller 650 may count a tap input as part of consecutive tap inputs when its sensing value is received within a predetermined input time after a previous sensing value is received. Furthermore, the controller 650 may initialize the number of tap inputs when no sensing value is received within a predetermined input time after a previous sensing value is received. For example, the predetermined input time may be 0.2 seconds, but the disclosure is not limited thereto.

The controller 650 may set the consecutive tap input number to heat the heater 630 to three times or more. This is to prevent the heater 630 from being heated due to the malfunction of the aerosol generating device 600. For example, when the aerosol generating device 600 falls and collides with the ground surface, the sensor 610 may generally output two times a sensing value that is greater than or equal to the variable threshold. In this case, the controller 650 may determine that the user's consecutive tap inputs are received and thus control the battery 620 to heat the heater 630. In this case, the heater 630 may be heated regardless of user's intention. Accordingly, in order to prevent heating of the heater 630 regardless of user's intention, the operation input number may be set to three times or more.

As the number of tap inputs to heat the heater 630 increases, user may experience more inconvenience. Accordingly, the controller 650 may set the operation input number to three times that is a lower limit of a setting range of the number of tap inputs (i.e., three times or more).

As described above, a user may apply three consecutive tap inputs to heat the heater 630. However, during the consecutive tap inputs, the strength of a tap input may be decreased.

A first graph 710 of FIG. 7 illustrates a decrease of user's touch strength according to the consecutive tap inputs.

As illustrated in FIG. 7, the user's touch strength may be maintained until the second tap input but sharply decreases from the third tap input. Specifically, the touch strength may be decreased due to finger stress generated by the consecutive tap inputs. If the a first threshold th1 is maintained without reflecting the decrease in strength, as the third tap input is less than the first threshold th1, the controller 650 may not count the tap input. Accordingly, even when a user inputs a tap input three times, the heater 630 is not heated, so the user has to apply tap inputs again. According to an embodiment, to reduce the above user inconvenience, the threshold may be adjusted according to the number of tap inputs.

According to the embodiment of the disclosure, the controller 650 may decrease the variable threshold in inverse proportion to the counted number of tap inputs as shown in Mathematical Expression 1.

$$\text{NUMBER OF TAP INPUTS} \propto \frac{1}{\text{VARIABLE THRESHOLD}} \quad \text{[Math Figure 1]}$$

A second graph 720 of FIG. 7 shows that, as the number of tap inputs increases, the variable threshold decreases.

In FIG. 7, a slope Δg of the variable threshold graph may be appropriately decreased considering the user's average touch strength of the aerosol generating device 600. For example, in the acceleration sensor, the slope Δg may be set to −0.7 mV/number. In this case, the variable threshold may gradually decrease to 7.2 mV, 6.3 mV, 5.6 mV, and 4.9 mV in inverse proportion to the user's tap input number. However, in the disclosure, initial set values of the slope and variable threshold are not limited to the above examples.

When the variable threshold is excessively decreased, a malfunction rate of the aerosol generating device 600 may rather increase. For example, in the acceleration sensor, when the variable threshold is set to be less than 4.9 mV, the acceleration sensor may sensitively react to the movement of the aerosol generating device 600 such that external noise, not the user's tap input, may be recognized as the user's tap input. In other words, when the variable threshold is excessively low, the aerosol generating device 600 may operate even without user's tap input. Accordingly, the controller 650 may decrease the variable threshold in inverse proportion to the user's tap input number from the first threshold th1 to the second threshold th2 only, and thereafter maintain the second threshold th2 even when the number of tap inputs increases.

The second graph 720 of FIG. 7 shows that the variable threshold decreases in inverse proportion to the number of tap inputs from the first threshold th1 to the second threshold th2 that is less than the first threshold th1. For example, when the sensor 610 is an acceleration sensor, the first threshold th1 may be 7.0 mV and the second threshold th2 may be 4.9 mV, but the disclosure is not limited thereto.

Decreasing the variable threshold may have the same meaning as increasing the sensitivity of the sensor 610 as shown in Mathematical Expression 2.

$$\text{NUMBER OF TAP INPUTS} \propto \text{SENSITIVITY} \quad \text{[Math Figure 2]}$$

Accordingly, the controller 650 may increase the variable sensitivity of the sensor 610 from a first sensitivity degree to a second sensitivity degree in proportion to the number of tap inputs. For example, when the sensor 610 is an acceleration sensor, the first sensitivity degree may be 1.6, and the second sensitivity degree may be 2.4, but the disclosure is not limited thereto.

As shown in FIG. 7, as the controller 650 may decrease the variable threshold of the sensor 610 in proportion to the number of tap inputs, the third tap input still exceeds the current variable threshold (i.e., the second variable threshold th2). Accordingly, the aerosol generating device 600 of the disclosure may accurately recognize the user's three consecutive tap inputs. Accordingly, the user inconvenience may be reduced.

Figure 8:
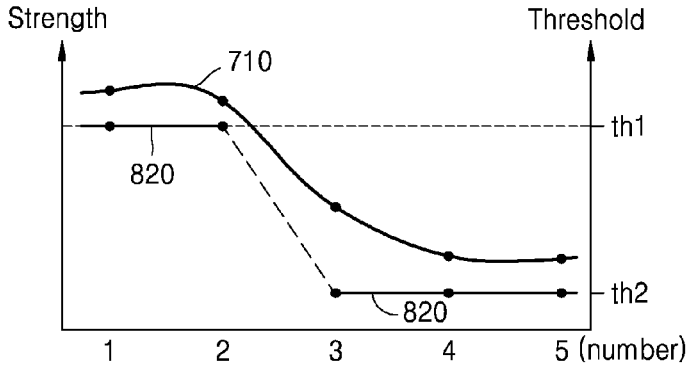
FIG. 8 is a graph of a method of adjusting a threshold of a sensor, according to another embodiment of the disclosure.

FIG. 8 is a graph of a method of adjusting a threshold of a sensor according to another embodiment of the disclosure.

Referring to FIG. 8, the aerosol generating device 600 may receive a user input to heat the heater 630. Specifically, the aerosol generating device 600 may receive user's consecutive tap inputs to heat the heater 630.

The sensor 610 may receive the user's consecutive tap inputs to heat the heater 630.

The controller 650 may count the number of tap inputs. The controller 650 may count a tap input as part of consecutive tap inputs when its sensing value is received within a predetermined input time after a previous sensing value is received. Furthermore, the controller 650 may initialize the number of tap inputs when no sensing value is received within a predetermined input time after a previous sensing value is received. For example, the predetermined input time may be 0.2 seconds, but the disclosure is not limited thereto.

According to another embodiment of the disclosure, the controller 650 may set an operation input number to three times to prevent a malfunction of the aerosol generating device 600. As described above, a user may have to apply three consecutive tap inputs to heat the heater 630, and during the consecutive tap inputs, the strength of a tap input may be decreased.

According to another embodiment of the disclosure, the controller 650 may initialize the variable threshold to the first threshold th1. The controller 650 may decrease the variable threshold from first threshold th1 to the second threshold th2 less than the first threshold th1 only after the counted number of tap inputs reaches a reference input number while maintaining the variable threshold at the first threshold th1. For example, when the sensor 610 is an acceleration sensor, the first threshold th1 may be 7.0 mV, and the second threshold th2 may be 4.9 mV, but the disclosure is not limited thereto.

The reference input number may be set to be less than the operation input number. For example, the operation input number may be set to three times, and the reference input number may be set to two times.

As described in FIG. 7, decreasing the variable threshold has the same meaning as increasing the sensitivity of the sensor 610. In this regard, the controller 650 may increase the variable sensitivity from a first sensitivity degree to a second sensitivity degree that is greater than the first sensitivity degree, when the counted number of tap inputs reaches the reference input number while maintaining the variable sensitivity at the first sensitivity degree. For example, when the first threshold th1 and the second threshold of the acceleration sensor are 7.2 mV and 4.9 mV, respectively, the first sensitivity degree and the second sensitivity degree may be 1.6 and 2.4, respectively, but the disclosure is not limited thereto.

In FIG. 8, after the second tap input is received while maintaining the variable threshold at the first threshold th1, the controller 650 decreases the variable threshold to the second threshold th2. As a result, the third tap input still exceeds the current variable threshold (i.e., the second threshold th2). Accordingly, the aerosol generating device 600 of the disclosure may accurately recognize the user's consecutive tap inputs. Accordingly, the user inconvenience may be reduced.

In this case, as the aerosol generating device 600 does not constantly vary the variable threshold over time, the implementation thereof may be easy and control convenience may be increased.

Figure 9:
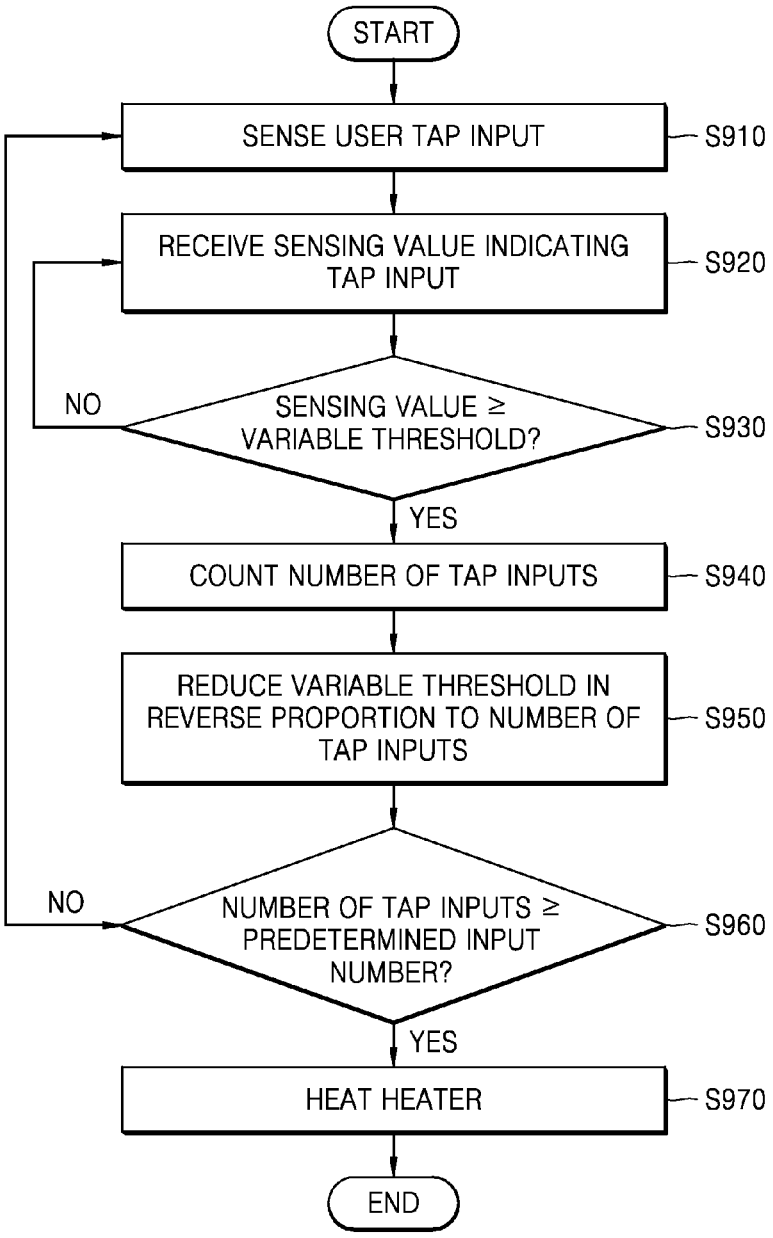
FIG. 9 is a flowchart of a method of operating an aerosol generating device, according to an embodiment of the disclosure.

FIG. 9 is a flowchart of a method of operating an aerosol generating device according to an embodiment of the disclosure.

Referring to FIG. 9, the sensor 610 may sense a user's tap input (S910).

If the sensor 610 is an acceleration sensor, the acceleration sensor may sense a change of acceleration of the aerosol generating device 600 with respect to the user's tap input, and output a voltage in proportion to the change of acceleration voltage. The acceleration sensor may output a sensing value to the controller 650 in response to the change of acceleration of the aerosol generating device 600.

The controller 650 may receive from the sensor 610 a sensing value indicating the tap input (S920).

If the sensor 610 is an acceleration sensor, the controller 650 may receive a certain voltage as the sensing value, but the disclosure is not limited thereto.

The controller 650 may calculate whether the sensing value received from the sensor 610 is greater than or equal to the predetermined variable threshold (S930). The variable threshold may mean a minimum sensing value for recognizing the user's tap input.

When the sensing value is greater than or equal to the predetermined variable threshold, the controller 650 may count the sensing value as the user's tap input.

The controller 650 may count the number of tap inputs (S940). To this end, the controller 650 may include the counter 651.

The controller 650 may count the number of tap inputs when a sensing value is received within a predetermined input time after a previous sensing value is received. Furthermore, the controller 650 may initialize the number of tap inputs when no sensing value is received within a predetermined input time after a previous sensing value is received. In this case, the predetermined input time may be appropriately set considering the user's consecutive tap input time. For example, the predetermined input time may be 0.2 seconds, but the disclosure is not limited thereto.

The controller 650 may decrease the variable threshold in proportion to the counted number of tap inputs (S950).

In detail, the controller 650 may decrease the variable threshold from the first threshold th1 to the second threshold th2 less than the first threshold th1 in proportion to the number of tap inputs. For example, when the sensor 610 is an acceleration sensor, the slope $\Delta g$ may be $-0.7$ mV, but the disclosure is not limited thereto.

Decreasing the variable threshold may have the same meaning as increasing the sensitivity of the sensor 610 as shown in Mathematical Expression 2.

Accordingly, the controller 650 may increase the variable sensitivity of the sensor 610 from the first sensitivity degree to the second sensitivity degree in proportion to the number of tap inputs. For example, when the sensor 610 is an acceleration sensor, the first sensitivity degree may be 1.6, and the second sensitivity degree may be 2.4, but the disclosure is not limited thereto.

The controller 650 may initialize the variable threshold when no sensing value is received within the predetermined input time after the variable threshold is adjusted. In this case, the predetermined input time may be appropriately set considering the user's consecutive tap input time. For example, the predetermined time may be 0.2 seconds, but the disclosure is not limited thereto. The reason for initializing the variable threshold is that, when the reduced variable threshold is maintained even without a user's tap input, a malfunction of the aerosol generating device 600 may occur.

The controller 650 may calculate whether the number of tap inputs is greater than or equal to the predetermined operation input number (S960). The operation input number may refer to the number of consecutive tap inputs for heating the heater 630, and it may be stored in the memory 640.

The controller 650 may set the consecutive tap input number to heat the heater 630 to three times or more. This is to prevent heating of the heater 630 due to the malfunction of the aerosol generating device 600.

For example, when the aerosol generating device 600 falls and collides with the ground surface, the sensor 610 generally outputs two times a sensing value that is greater than or equal to the variable threshold. In this case, the controller 650 may determine that the user's consecutive tap inputs are received, and may control the battery 620 to heat the heater 630. Accordingly, the heater 630 may be heated regardless of user's intention. Accordingly, to prevent the heating of the heater 630 regardless of user's intention, the operation input number may be set to three times or more.

As the number of tap inputs to heat the heater 630 increases, the user inconvenience may be increased. Accordingly, for example, the controller 650 may set the operation input number to three times that is a lower limit of a setting range of the number of tap inputs (i.e., three times or more).

When the number of tap inputs is less than the operation input number, the controller 650 may continue to detect the user's tap input.

When the number of tap inputs reaches an operation input number, the controller 650 may control the battery 620 to supply power to the heater 630. The heater 630 may be heated on the basis of the power supplied by the battery 620 (S970).

Figure 10:
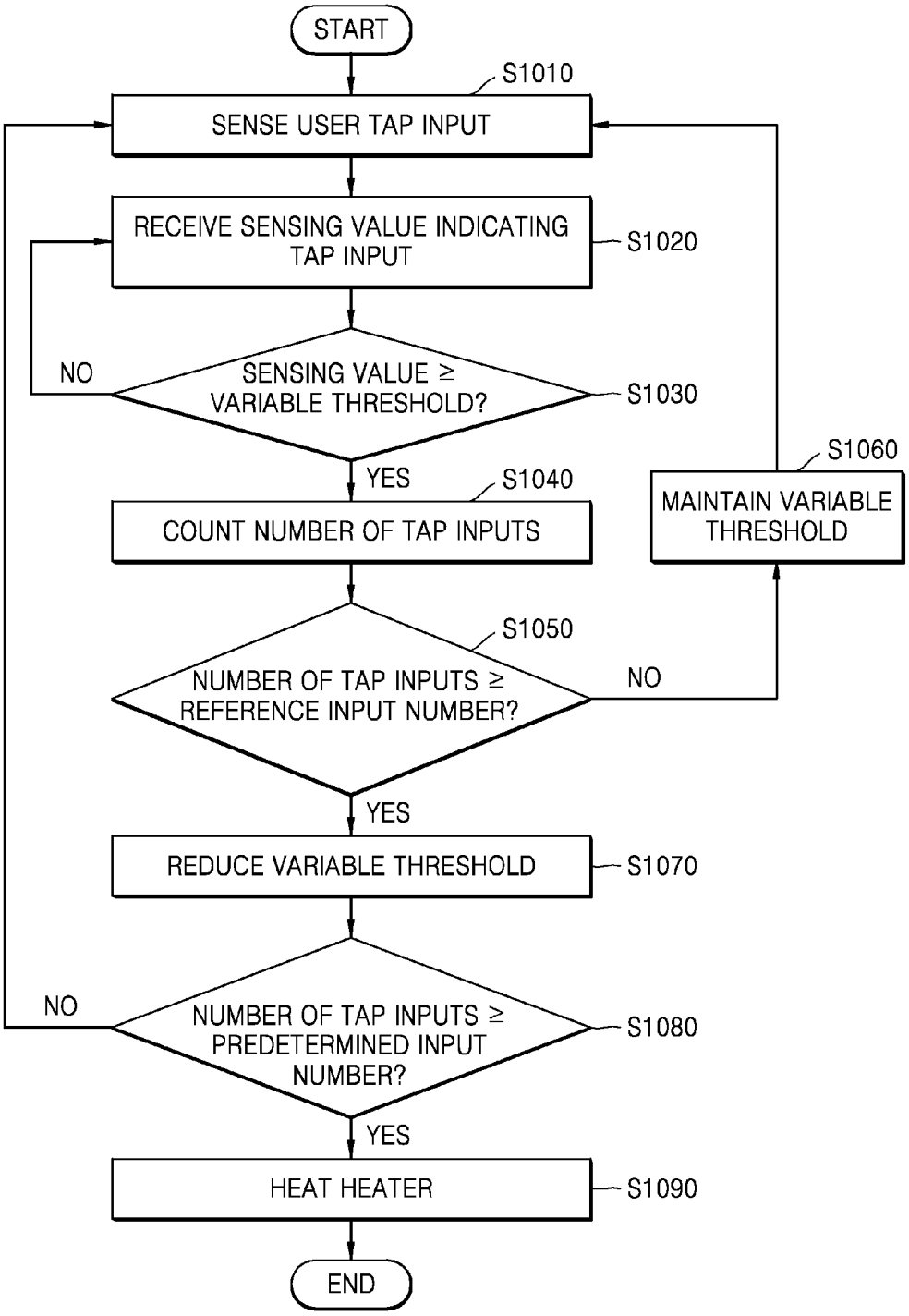
FIG. 10 is a flowchart of a method of operating an aerosol generating device, according to another embodiment of the disclosure.

FIG. 10 is a flowchart of a method of operating an aerosol generating device, according to another embodiment of the disclosure.

The method of FIG. 10 is different from that of FIG. 9 in terms of a method of adjusting a variable threshold. As S1010, S1020, S1030, and S1040 of FIG. 10 are respectively the same as S910, S920, S930, and S940 of FIG. 9, in the following description, operations after S1050 are described.

Referring to FIG. 10, the controller 650 may calculate whether the number of tap inputs is a reference input number or more (S1050).

When the number of tap inputs is less than the reference input number, the controller 650 may maintain an initial variable threshold (S1060). For example, when the number of tap inputs is less than the reference input number, the controller 650 may maintain a first threshold.

When the number of tap inputs is greater than or equal to the reference input number or more, the controller 650 may decrease the variable threshold (S1070).

When the number of tap inputs reaches the reference input number, the controller 650 may decrease the variable threshold to a second threshold that is less than the first threshold. For example, when the sensor 610 is an acceleration sensor, the first threshold th1 may be 7 mV, and the second threshold th2 may be 4.9 mV, but the disclosure is not limited thereto.

Decreasing the variable threshold has the same meaning as increasing the sensitivity of the sensor 610. In this regard, the controller 650 may increase the variable sensitivity to from the first sensitivity degree to the second sensitivity degree that is greater than the first sensitivity degree, when the counted number of tap inputs reaches the reference input number while the variable sensitivity is maintained at the first sensitivity degree.

In this case, as the aerosol generating device 600 does not constantly vary the variable threshold over time, the implementation thereof may be easy and control convenience may be increased.

The reference input number may be set to be less than the operation input number. For example, the operation input number may be set to three times, and the reference input number may be set to two times.

The controller 650 may initialize the variable threshold when no sensing value is received within the predetermined input time after the variable threshold is adjusted. In this case, the predetermined input time may be appropriately set considering the user's consecutive tap input time. For example, the predetermined time may be 0.2 seconds, but the disclosure is not limited thereto. The reason for initializing the variable threshold is that a malfunction of the aerosol generating device 600 may easily occur if the adjusted variable threshold is maintained even without additional user's tap inputs.

The controller 650 may determine whether the number of tap inputs is greater than or equal to the predetermined operation input number (S1080). The operation input number may refer to the number of consecutive tap inputs for heating the heater 630, and it may be stored in the memory 640.

The controller 650 may set the operation input number to three times or more. This is to prevent heating of the heater 630 due to the malfunction of the aerosol generating device 600.

For example, when the aerosol generating device 600 falls and collides with the ground surface, the sensor 610 generally outputs two times a sensing value that is greater than or equal to the variable threshold. In this case, the controller 650 may determine that the user's consecutive tap inputs are received, and may control the battery 620 to heat the heater 630. Accordingly, the heater 630 may be heated regardless of user's intention. Accordingly, to prevent the heating of the heater 630 regardless of user's intention, the operation input number may be set to three times or more.

As the number of tap inputs to heat the heater 630 increases, the user inconvenience may be increased. Accordingly, for example, the controller 650 may set the operation input number to three times that is a lower limit of a setting range of the number of tap inputs (i.e., three times or more).

If the number of tap inputs is less than the operation input number, the controller 650 may continue to detect the user tap input.

When the number of tap inputs is greater than or equal to an operation input number, the controller 650 may control the battery 620 to supply power to the heater 630. The heater 630 may be heated on the basis of the power supplied by the battery 620 (S1090).

One embodiment may also be implemented in the form of a recording medium including instructions executable by a computer, such as a program module executable by the computer. A computer-readable medium may be any available medium that can be accessed by a computer and includes both volatile and nonvolatile media, and removable and non-removable media. In addition, the computer-readable medium may include both a computer storage medium and a communication medium. The computer storage medium includes all of volatile and nonvolatile, and removable and non-removable media implemented by any method or technology for storage of information such as computer-readable instructions, data structures, program modules or other data. The communication medium typically includes computer-readable instructions, data structures, other data in modulated data signals such as program modules, or other transmission mechanisms, and includes any information transfer media.

At least one of the components, elements, modules or units (collectively "components" in this paragraph) represented by a block in the drawings such as the controller 12 and the counter 651 in FIGS. 1-3 and 6, may be embodied as various numbers of hardware, software and/or firmware structures that execute respective functions described above, according to an exemplary embodiment. For example, at least one of these components may use a direct circuit structure, such as a memory, a processor, a logic circuit, a look-up table, etc. that may execute the respective functions through controls of one or more microprocessors or other control apparatuses. Also, at least one of these components may be specifically embodied by a module, a program, or a part of code, which contains one or more executable instructions for performing specified logic functions, and executed by one or more microprocessors or other control apparatuses. Further, at least one of these components may include or may be implemented by a processor such as a central processing unit (CPU) that performs the respective functions, a microprocessor, or the like. Two or more of these components may be combined into one single component which performs all operations or functions of the combined two or more components. Also, at least part of functions of at least one of these components may be performed by another of these components. Further, although a bus is not illustrated in the above block diagrams, communication between the components may be performed through the bus. Functional aspects of the above exemplary embodiments may be implemented in algorithms that execute on one or more processors. Furthermore, the components represented by a block or processing steps may employ any number of related art techniques for electronics configuration, signal processing and/or control, data processing and the like.

Those of ordinary skill in the art related to the present embodiments may understand that various changes in form and details can be made therein without departing from the scope of the characteristics described above. The disclosed methods should be considered in a descriptive sense only and not for purposes of limitation. The disclosed methods should be considered from an illustrative point of view, not from a restrictive point of view. The scope of the present disclosure is defined by the appended claims rather than by the foregoing description, and all differences within the scope of equivalents thereof should be construed as being included in the present disclosure.

The invention claimed is:

1. An aerosol generating device comprising:

a heater configured to heat an aerosol generating substrate;

at least one sensor configured to sense a tap input of a user; and a controller configured to receive a sensing value indicating the tap input from the at least one sensor, count a number of tap inputs based on the received sensing value being greater than a variable threshold corresponding to a minimum sensing value for recognizing the tap input, and operate the heater based on whether the counted number of tap inputs reaches a predetermined input number, wherein the controller adjusts the variable threshold corresponding to the minimum sensing value for recognizing the tap input based on the counted number of tap inputs.

2. The aerosol generating device of claim 1, wherein the controller decreases the variable threshold corresponding to the minimum sensing value for recognizing the tap input in inverse proportion to the counted number of tap inputs.

3. The aerosol generating device of claim 1, wherein the controller decreases the variable threshold corresponding to the minimum sensing value for recognizing the tap input based on the counted number of tap inputs reaching a reference input number.

4. The aerosol generating device of claim 3, wherein the reference input number is set to two times.

5. The aerosol generating device of claim 1, wherein, the controller counts the number of tap inputs based on the sensing value being received within a predetermined input time after a previous sensing value is received.

6. The aerosol generating device of claim 5, wherein the controller further comprises a counter configured to count the number of tap inputs.

7. The aerosol generating device of claim 1, wherein the controller initializes the variable threshold corresponding to the minimum sensing value for recognizing the tap input based on no sensing value being received within a predetermined input time after the variable threshold corresponding to the minimum sensing value for recognizing the tap input is adjusted.

8. The aerosol generating device of claim 1, wherein the at least one sensor comprises an acceleration sensor that senses a change of acceleration of the aerosol generating device.

9. The aerosol generating device of claim 1, further comprising a battery configured to supply power to the heater, wherein the controller controls the battery to supply power to the heater based on the counted number of tap inputs reaching the predetermined input number.

10. A method of operating an aerosol generating device, the method comprising:

sensing a tap input of a user;

receiving a sensing value indicating the tap input;

counting a number of tap inputs based on the received sensing value being greater than a variable threshold corresponding to a minimum sensing value for recognizing the tap input; and adjusting the variable threshold corresponding to the minimum sensing value for recognizing the tap input based on the counted number of tap inputs.

11. The method of claim 10, wherein the adjusting of the variable threshold corresponding to the minimum sensing value for recognizing the tap input comprises decreasing the variable threshold corresponding to the minimum sensing value for recognizing the tap input in inverse proportion to the counted number of tap inputs.

12. The method of claim 10, wherein the adjusting of the variable threshold corresponding to the minimum sensing value for recognizing the tap input comprises, decreasing the variable threshold corresponding to the minimum sensing value for recognizing the tap input based on the counted number of tap inputs reaching a reference input number.

13. The method of claim 10, wherein the counting of the number of tap inputs comprises counting the number of tap inputs based on the sensing value being received within a predetermined input time after a previous sensing value is received.

14. The method of claim 10, further comprising initializing the variable threshold corresponding to the minimum sensing value for recognizing the tap input based on no sensing value being received within a predetermined input time after the variable threshold corresponding to the minimum sensing value for recognizing the tap input is adjusted.

15. The method of claim 10, further comprising supplying power to a heater based on the counted number of tap inputs reaching a predetermined input number.

* * * * *